US010989207B2

(12) United States Patent
Kraft

(10) Patent No.: US 10,989,207 B2
(45) Date of Patent: Apr. 27, 2021

(54) LOW PROFILE DIRECTIONAL CENTRIFUGAL CEILING FAN

(71) Applicant: Joseph Kraft, College Station, TX (US)

(72) Inventor: Joseph Kraft, College Station, TX (US)

( * ) Notice: Subject to any disclaimer, the term of this patent is extended or adjusted under 35 U.S.C. 154(b) by 0 days.

(21) Appl. No.: 15/983,162

(22) Filed: May 18, 2018

(65) Prior Publication Data

US 2019/0353173 A1 Nov. 21, 2019

(51) Int. Cl.

| | |
|---|---|
| ***F04D 25/08*** | (2006.01) |
| ***F04D 29/42*** | (2006.01) |
| ***F04D 17/16*** | (2006.01) |
| ***F04D 29/00*** | (2006.01) |
| ***F04D 29/30*** | (2006.01) |
| ***F04D 29/28*** | (2006.01) |

(52) U.S. Cl.

CPC ..... *F04D 25/088* (2013.01); *F04D 17/16* (2013.01); *F04D 29/005* (2013.01); *F04D 29/282* (2013.01); *F04D 29/30* (2013.01); *F04D 29/4226* (2013.01)

(58) Field of Classification Search

CPC .... F04D 25/088; F04D 17/16; F04D 29/4226; F04D 29/282; F04D 29/281; F04D 29/4213; F16C 1/16; F15D 1/0015; F24F 7/00

See application file for complete search history.

(56) References Cited

U.S. PATENT DOCUMENTS

| | | | | |
|---|---|---|---|---|
| 5,154,893 | A * | 10/1992 | Nakade | A61L 9/122 422/122 |
| 5,620,370 | A * | 4/1997 | Umai | F04D 29/4213 454/354 |
| 6,979,169 | B2 * | 12/2005 | Penlesky | F04D 29/4226 415/1 |
| 7,066,712 | B2 * | 6/2006 | Kim | F04D 17/165 415/58.4 |
| 7,507,074 | B2 * | 3/2009 | Munshi | F04D 25/088 248/343 |
| 9,097,265 | B1 * | 8/2015 | Tom | F04D 29/626 |
| 9,719,525 | B2 * | 8/2017 | Cunnane | F04D 25/088 |
| 9,797,404 | B2 * | 10/2017 | Karst | F04D 25/166 |
| 10,371,409 | B2 * | 8/2019 | Yang | F04D 17/16 |
| 10,487,852 | B2 * | 11/2019 | Avedon | F04D 29/601 |
| 2018/0155036 | A1 * | 6/2018 | Hampe, Jr. | B64D 13/00 |
| 2019/0113221 | A1 * | 4/2019 | Huang | F04D 29/005 |

* cited by examiner

*Primary Examiner* — Richard A Edgar
*Assistant Examiner* — Jackson N Gillenwaters
(74) *Attorney, Agent, or Firm* — Furr Law Firm; Jeffrey Furr, Esq.

(57) ABSTRACT

This new ceiling fan is designed to improve functionality of the airflow and to decrease the obtrusive appearance of the traditional axial ceiling fan by incorporating the lower profile airflow technology of a centrifugal fan. The main advantages are that it is much smaller with a lower profile that is mounted flat against the ceiling and can have more focused directional airflow thus enabling a user to feel more air circulation in the specific area of the room. The fan can also be set to oscillate around the room for more diffuse air circulation. Low profile lighting kits can be designed into the lower cover. This new design should be easily mountable on existing ceiling fan electrical boxes. Ideally it could be controlled with the same remote control technology available today for floor standing oscillating fans.

8 Claims, 2 Drawing Sheets

LOW PROFILE DIRECTIONAL CENTRIFUGAL CEILING FAN

FIELD OF INVENTION

This device refers to the field of airflow circulation and specifically to electric fans and more specifically to ceiling fans.

BACKGROUND OF THE INVENTION

Ceiling fans have been utilized for over a hundred years in some form or another to provide environmental comfort. Ceiling fans that are currently available have an axial design and have significant airflow limitations. Being axial fans with airflow generally limited to an area defined by the axial airflow column, the area of significant airflow comfort is very limited, being only slightly larger than the diameter of the fan blade path itself. This airflow limitation is not the only problem with currently available ceiling fans. Interior design trends have been moving away from the traditional axial fans to avoid the dated appearance of the newly designed spaces. Many homeowners are perplexed because, as much as they want the new updated appearance, they don't want to lose the benefit of the air circulation that the fan affords, albeit limited in area of airflow. This new design for a ceiling fan should help to bridge the gap between appearance and functionality and provide more comfort with a new updated appearance.

This new design accomplishes this by using a low profile centrifugal fan that has an air intake in the center of the lower surface and a directional air outflow in a small section of the periphery of the fan. Although this design may not generate as great of a total volume of air movement as does the traditional axial airflow design, it actually can be even more efficient in providing the desired air circulation, because in many situations the area of desired airflow is limited to a smaller part of the room. For example, if a person is sitting in a chair in a bedroom, they can direct the fan onto the area where they will be sitting and thus be much more efficient in use of the fan output. Also, just like so many of the floor standing fans in use today, this ceiling mounted version can have a setting that oscillates in a partial or complete rotation to provide more uniform air distribution around the room. One embodiment could even have a shroud that can be lowered exposing the 360 degree air outflow for omnidirectional air circulation.

This fan design also could easily incorporate many different lighting packages incorporated into the lower surface to provide a ceiling light source as well, but in a much smaller less obtrusive design than the traditional axial ceiling fan with a protruding lower light kit.

SUMMARY

Most ceiling fans today are large, somewhat obtrusive radial fans that tend to circulate air in an axial direction in an area limited to below the fan blades proper. Current trends in interior design are moving away from this somewhat antiquated design statement and are removing the ceiling fan completely. This device is a design that allows the homeowner to have improved and controllable air circulation with a much less obtrusive esthetic appearance.

DETAILED DESCRIPTION OF THE INVENTION

Figure 1:
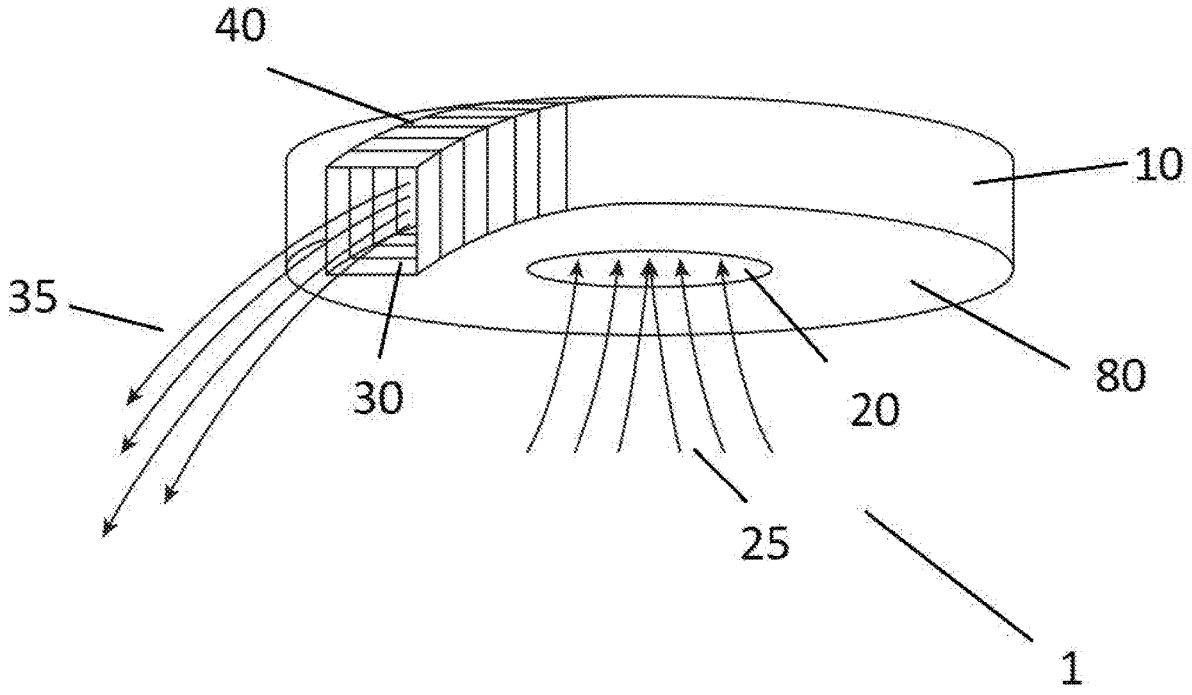
FIG. 1 depicts a profile view from below vantage point of one embodiment
Figure 2:
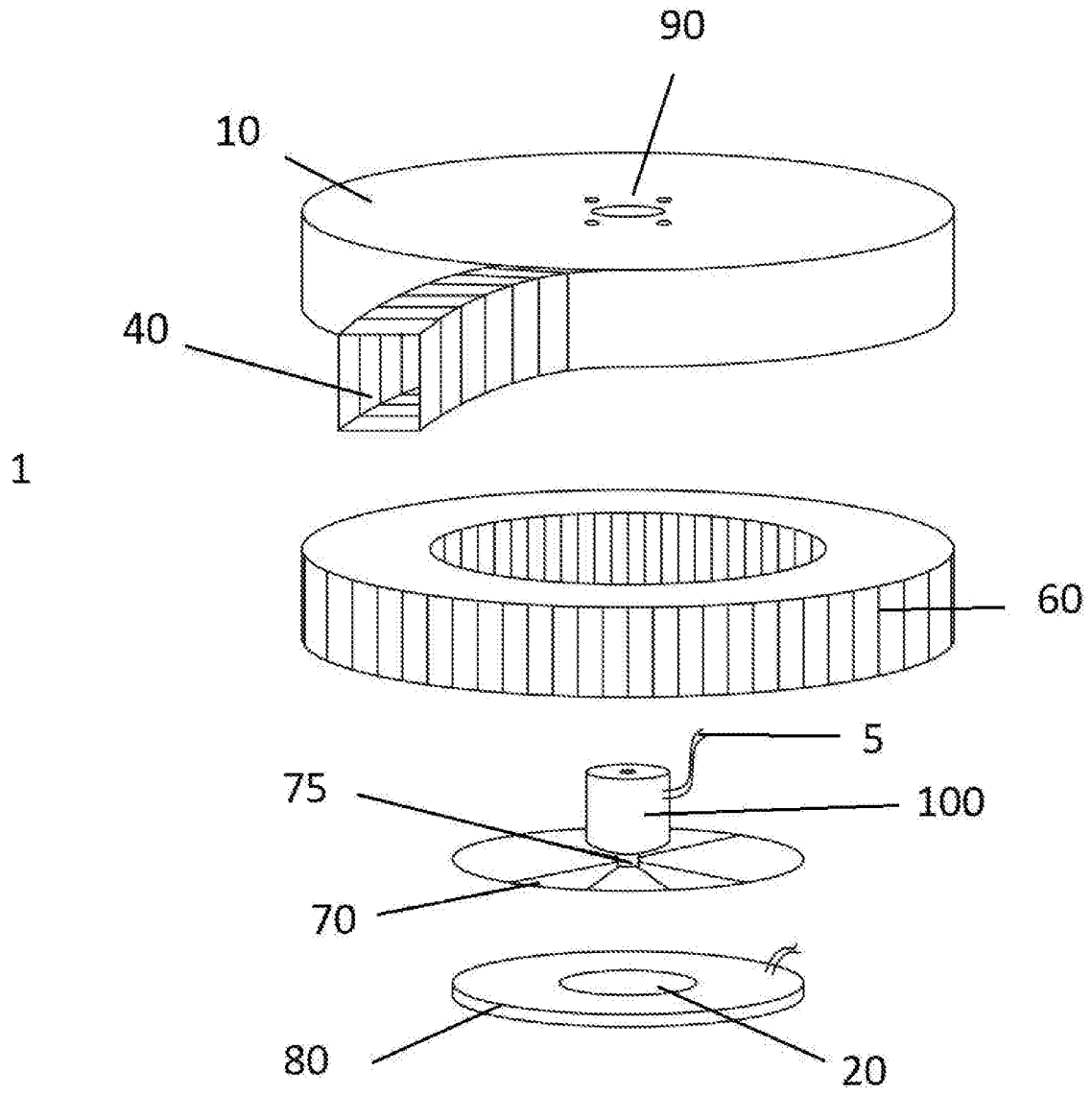
FIG. 2 depicts a partial exploded view of one embodiment

Ceiling fans have been around longer than electricity and provide many significant advantages in comfort levels in the areas where they are used. Traditionally an axial fan mechanism is what is used in order to circulate the most air possible. Recently there has been a trend to deviate from the obtrusive design of the traditional ceiling fan that hangs from the ceiling in a very traditional way. Many times the ceiling fan is removed completely and recessed lighting installed because it provides a much more sleek and unobtrusive appearance. This proposed new ceiling fan design is intended to reduce the visible obtrusiveness of the traditional axial ceiling fan while actually improving the functional air circulation benefit.

This new ceiling fan design no longer utilizes the traditional axial fan blade design that takes air in from above (or below depending on rotation direction). Instead, it utilizes a centrifugal fan design that pulls air in from below and distributes it radially and directionally. There are currently available industrial ceiling mounted centrifugal fans in production that distribute air in a 360 degree pattern in order to increase large space air mixing and thus increase efficiency of heating and cooling systems in large open spaces with high ceilings. The problem with this system for home use is that the air flow is not very perceptible to the people in the room who want to feel the air movement for the comfort factor that it provides. This is because when the fan is distributing the air in a 360 degree pattern it is diffused into the space so much the it is barely perceptible. There are other centrifugal fans that are used as floor standing or portable fans that utilize a very limited output area in order to channel the air circulation benefit to where it is desired maximally.

Traditionally, ceiling fans have blades that are designed for axial air flow. The blades of a traditional fan are mounted radially around a center axis and rotate around this axis forcing air in the direction of the axis itself. The radially mounted blade is pitched slightly in order to force air in an axial direction when rotated around this same axis. The pitch of the blade can create airflow in either axial direction depending on the direction of rotation. Historically, simple construction and manufacturing combined with generally adequate airflow have made the currently utilized pitched flat blade design the standard blade design for more than a century.

This proposed ceiling fan 1 is designed to combine some characteristics of all the above systems in order to provide a low profile hybrid ceiling fan 1 that has a channeled outflow 35 that can be adjusted to be felt in a specific desired area of a room. This directionality is accomplished by the use of a shroud 10 that surrounds a centrifugal fan blade assembly 60 and has an outflow port 40 that provides for directional airflow 35 through it. The outflow port 40 can be flexible and therefore can be directed at a specific desired location within the room.

The current invention is a fan 1 that utilizes a columnar centrifugal fan blade assembly 60 that rotates around an axis and provides radial airflow. This proposed fan has an outer fan housing 10 that encloses the fan blade assembly 60 with a directional tube 40 on the side of the fan housing 10. The housing 10 serves to cover the components of the fan 1 while also directing the outflow airflow 35 out of the fan 1 through the outflow port 40. The fan 1 has a centrifugal fan blade assembly 60 which is cylindrical in design with multiple perpendicularly positioned (with respect to the radius of the cylinder) small fan blades arranged vertically around the circumference of the blade assembly attached to a flat bottom and flat top in the preferred embodiment. Each small blade arranged around the perimeter of the fan blade assembly cylinder in an axial direction so that in a ceiling fan application they would be arranged vertically thus forcing air radially (horizontally) when assembly turns. The pitch of each blade would be directed so that when the blade assembly spins around the axis it pulls air in axially from below the assembly, through the center and out the periphery in a radial direction. The individual blades can be flat or curved to achieve optimum performance and efficiency. The centrifugal fan assembly 60 is attached to a fan mounting wheel 70. The mounting wheel 70 is attached to a motor 100 through an axle 75. The motor 100 has a power source 5. The motor 100 turns the axle 75, that is connected to the mounting wheel 70 that turns the attached centrifugal fan blade assembly 60. The mounting wheel 70 hangs from the motor 100 such that the centrifugal fan blade assembly 60 does not touch any of the surfaces of the housing 10 including a light cap 80 that is connected to the undersurface of the housing 10 and has a central opening 20 to allow adequate air inflow. In the preferred embodiment, the light cap 80 would have a light source that can be, but is not limited to, LED lights to provide light for the room in which the ceiling fan 1 is located. This light cap 80 can be designed in many different arrangements allowing for different styles and levels of lighting desired. Light sources are not limited to the light cap 80. In other embodiments the lights may be incorporated directly into the housing 10 allowing for many different styles and lighting effects.

The motor assembly 70 is attached centrally to the mounting bracket 90. The mounting bracket 90 is also connected circumferentially to the housing 10 with a rotating connection that allows the housing 10 to rotate freely around the mounting bracket 90. The housing 10 completely encloses the outer aspects of the centrifugal fan assembly 60 and connects circumferentially at its lower aspect to the outer circumference of the light cap 80. This allows for the airflow to enter the fan axially through the opening in the light cap 80 and exit radially through the outflow shoot 30 at the end of the tube 40 on the housing 10 so that the airflow is properly directed and not dissipated.

As to a further discussion of the manner of usage and operation of the present invention, the same should be apparent from the above description. Accordingly, no further discussion relating to the manner of usage and operation will be provided. With respect to the above description, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A device comprising:

a ceiling fan with a mounting bracket connected circumferentially to a housing with a rotating connection that allows the housing to rotate freely around the mounting bracket, where the housing has a bottom, connected to a circular side wall with an outflow port that can rotate around a vertical axis to allow for selective directionality of an outflow air stream with an end with an outflow shoot at the end of the port, a motor that is attached to said housing and a centrifugal fan assembly attached to said motor where the centrifugal fan assembly is cylindrical with a plurality of fan blades perpendicularly positioned to a radius of the cylinder arranged vertically around the circumference of the fan assembly with a top and bottom where the blades are attached, a cap connected circumferentially to bottom of side housing where the cap has an opening for air inflow, where each blade would have a fixed pitch so that when the fan assembly spins around its axis the rotational movement of the blades, each with a fixed pitch, pulls air inward axially from below the fan assembly and forces the air out the periphery in a radial direction determined by the direction of the outflow shoot where the housing completely encloses the outer aspects of the fan assembly.

2. A device according to claim 1 wherein the cap has LED lights.

3. The device according to claim 1 comprising;

a fan mounting wheel that connects the motor to the centrifugal fan.

4. The device according to claim 1 comprising;

each blade is positioned around the perimeter of the fan assembly cylinder in an axial direction.

5. The device according to claim 1 comprising;

where the centrifugal fan assembly is attached to said motor by an axle.

6. The device according to claim 1 comprising;

where the fan mounting wheel is attached to said motor by an axle.

7. The device according to claim 1 comprising;

where the blades are flat.

8. The device according to claim 1 comprising;

where the blades are curved.

* * * * *